United States Patent [19]

Maynard et al.

[11] Patent Number: 4,600,470

[45] Date of Patent: Jul. 15, 1986

[54] METHOD FOR ETCHING SMALL-RATIO APERTURES INTO A STRIP OF CARBON STEEL

[75] Inventors: Richard B. Maynard, Colerain Township, Lancaster County; John J. Moscony, Manheim Township, Lancaster County; Margaret H. Saunders, East Lampeter Township, Lancaster County, all of Pa.

[73] Assignee: RCA Corporation, Princeton, N.J.

[21] Appl. No.: 723,654

[22] Filed: Apr. 16, 1985

[51] Int. Cl.[4] ..... C23F 1/02; B44C 1/22; C03C 15/00; C03C 25/06

[52] U.S. Cl. ..... 156/644; 156/640; 156/642; 156/661.1; 156/345; 252/79.2

[58] Field of Search ..... 156/640, 644, 642, 656, 156/659.1, 661.1, 664, 345; 252/79.2; 430/23, 313, 318

[56] References Cited

U.S. PATENT DOCUMENTS

| | | | |
|---|---|---|---|
| 3,679,500 | 7/1972 | Kubo et al. | 156/11 |
| 3,971,682 | 7/1976 | Frantzen et al. | 156/11 |
| 4,126,510 | 11/1978 | Moscony et al. | 156/626 |
| 4,482,426 | 11/1984 | Maynard et al. | 156/640 |

OTHER PUBLICATIONS

R. B. Maynard et al., "Ferric Chloride Etching of Low Carbon Steels", *RCA Review* 45, 73–89, (Mar. 1984).

*Primary Examiner*—William A. Powell

*Attorney, Agent, or Firm*—Eugene M. Whitacre; Dennis H. Irlbeck; Vincent J. Coughlin, Jr.

[57] ABSTRACT

A method for etching an array of apertures through a carbon-steel sheet wherein, for each of the majority of said apertures, the ratio of the desired smallest cross-sectional dimension thereof to the thickness of said sheet is less than about 0.9, said sheet having etch-resistant stencils on opposite major surfaces thereof, said method comprising contacting said stencilled major surfaces with ferric chloride etchant having a specific gravity in a range at which a smooth finish is realized.

9 Claims, 3 Drawing Figures

METHOD FOR ETCHING SMALL-RATIO APERTURES INTO A STRIP OF CARBON STEEL

BACKGROUND OF THE INVENTION

This invention relates to a novel method for etching small-ratio precisely-sized and shaped apertures into a strip of carbon steel. The etched product may be used to make shadow masks for color display cathode-ray tubes, as well as other precision-etched products.

A common type of color display cathode-ray tube comprises an evacuated glass envelope having a glass viewing window, a luminescent viewing screen supported by the inner surface of the viewing window, a formed shadow mask closely spaced from the viewing screen and an electron-gun mount assembly for generating one or more electron beams for selectively exciting the screen to luminescence. The formed shadow mask, which is a thin metal membrane having an array of precisely-sized and shaped apertures therethrough, is used as a photographic master for making the screen, and then is used, during the operation of the tube, to aid in color selection on the screen by shadowing the electron beams. For both of these functions, it is important that the apertures therein follow closely in sizes and shapes with the mask specifications.

A flat mask is ordinarily made in several steps including producing etch-resistant stencils on opposite surfaces of a strip of low-carbon steel and then etching apertures through the stencilled strip with a ferric-chloride etchant. The flat mask is then removed from the strip and formed to a desired shape. The strip is ordinarily about 0.10 to 0.20 mm (4 to 8 mils) thick, and the apertures therein may be round or slit shaped and may range in their smallest cross-sectional dimension (diameter or width) from about 0.25 mm (10 mils) to less than the thickness of the strip. In addition, the profiles of the apertures are tapered so as to reduce scattering of electrons during tube operation. Each aperture has tapered sides that terminate at its smallest periphery (diameter or width) which periphery defines the shape and size of the aperture and of the electron beamlet to pass therethrough. That smallest periphery should be precisely shaped, and the tapered surface should be as smooth as possible to aid in achieving this feature and also to reduce electron scattering.

The parameters to be controlled during the etching phase for low-carbon-steel shadow masks are well known in the art. These parameters include control of etchant temperature, Baumé (specific gravity), redox potential, free-acid concentration, line speed, spray pressure and location of spray nozzles with respect to the metal strip in the etch chamber. Present factory practice is to use ferric chloride etchant with the lowest possible Baumé in order to achieve the highest possible etching rate. This frequently produces rough etch resulting in high visual nonuniformity in the finished mask due to ordinary slight variations in Baumé during etching. Visual nonuniformity of a shadow mask is evaluated subjectively by observing the illuminated array of apertures from the side of the mask with the larger tapers.

By rough or smooth etch, we refer to the surface roughness of the metal on the inside etched surfaces of the apertures in the shadow mask. A surface roughness equal to or less than 10 microinches (smooth etch) results in a mask with low visual nonuniformity. Increases above this value in surface roughness (rough etch) are known to contribute to a general increase in visual nonuniformity to transmitted light in the finished mask. This, in turn, degrades the ambient appearance of the phosphor screen produced with the mask, and also degrades the white uniformity of the screen in an operating picture tube.

At the present time, there are basically two types of color display cathode-ray tubes being produced. The first type is for television and general entertainment applications and is considered to have relatively low definition of the displayed video images. The second type is generally used for the display of data in the form of character, numerical and graphic information and is considered to have relatively medium or high definition. The principal factors which distinguish between these two tube types are the aperture sizes and aperture densities of the shadow masks. Generally, the second type has greater aperture density, smaller aperture sizes in the range of 0.05 to 0.15 mm (2 to 6 mils) and smaller aperture size/material thickness ratios. A practical method for distinguishing between entertainment and display type shadow masks is by the ratio of the aperture size (the smallest dimensions of the majority apertures) to the thickness of the shadow-mask membrane. In general, a mask having apertures with an aperture size/thickness ratio greater than 1.0, also referred to herein as having large-ratio apertures, describes a low-definition shadow mask used for entertainment or other low definition uses, while a mask having apertures with an aperture size/thickness ratio less than one is indicative of either a medium-or high-definition shadow mask used for data display. As the ratio of aperture size to material thickness becomes smaller, the visual nonuniformity in the shadow mask becomes greater. This is a problem for ratios in the range of about 1.0 to 2.0 and is a critical problem for etching apertures with ratios less than about 0.90, also referred to herein as small-ratio apertures.

We reported in our publication (cited below) that, when etching carbon steels with ferric chloride etchants of different specific gravities, an abrupt decrease in surface roughness occurs as the Baumé is increased and/or the temperature of the etchant is decreased. Concurrent with the rapid decrease in surface roughness is the equally-sudden appearance of uniform aperture size among nearest neighbor apertures and radical improvement in the overall visual nonuniformity of the etched mask. Both of these characteristics appear to be the manifestations of a change in the reaction kinetics occurring at the surface of the low carbon steel during etching and are a function of particular Baumé and temperature combinations of the etchant. We have applied our recent discovery to provide a novel method for etching small-ratio apertures in carbon steel sheet, and particularly for etching shadow masks with the majority of the apertures therein having ratios, aperture size-to-thickness, of less than about 0.90 and exhibiting minimal visual nonuniformity.

SUMMARY OF THE INVENTION

The novel method, as in prior methods, includes contacting the stencilled major surfaces of a strip of carbon steel with a ferric chloride etchant until the desired amount of etching is completed. Unlike prior methods, the ferric-chloride etchant is controlled to have a Baumé (specific gravity) in a range in which a smooth finish is realized. Generally, the temperature of the etchant is in the range of about 40° to 80° C. and the minimum Baumé, $y_{min}$, of the etchant is defined by the relation:

$$y_{min}=25.05+4.97\ ln\ T$$

where: T is the temperature of the etchant in degrees Celsius °C. The maximum Baumé, $y_{max}$, of the etchant is defined by the relation:

$$y_{max}=7.11+10.65\ ln\ T.$$

The most productive combinations during etching employ the higher temperatures, and the lowest specific gravities at which smooth etch can be achieved.

DETAILED DESCRIPTION OF THE PREFERRED EMBODIMENT

Figure 1:
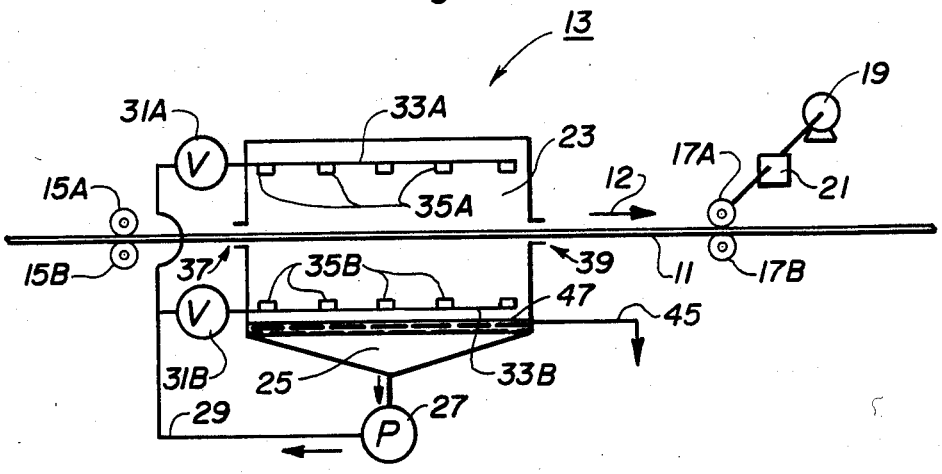
FIG. 1 is a schematic representation of an apparatus that may be used for practicing the novel method.

The novel method may be practiced in the continuous etching apparatus disclosed in U.S. Pat. No. 4,126,510 issued Nov. 21, 1973 to J. J. Moscony et al. FIG. 1 herein is a schematic representation of a similar apparatus modified to permit the continuous removal of accumulated ferric and ferrous ions from the etchant. The novel method may be practiced in other apparatus ordinarily used for etching apertures into a strip of metal.

FIG. 1 shows a horizontally-oriented strip 11 of carbon steel to be etched while it is moving through an etching station 13 from left to right as shown by the arrow 12. The strip 11, which is about 21.375 inches wide and 0.15 mm (6 mils) thick, moves at about 150 to 450 cm (about 60 to 180 inches) per minute through the station. The strip 11 carries etch-resistant stencils on both major surfaces, substantially as described in U.S. Pat. No. 4,061,529 issued Dec. 6, 1977 to A. Goldman et al. The strip 11 is supported between a first pair of rollers 15A and 15B and a second pair of rollers 17A and 17B on the entrance and exit sides, respectively, of the etching station 13. The strip 11 is moved by the rotation of the upper roller 17A of the second pair, which is driven by a motor 19 through a variable-speed reducer 21.

The etching station 13 comprises a closed etching chamber 23, the bottom of which is a sump 25 below the strip 11. Liquid etchant in the sump is pumped by a pump 27 through piping 29 through top and bottom valves 31A and 31B through top and bottom headers (not shown) into spray tubes 33A and 33B respectively and sprayed out of upper and lower nozzles 35A and 35B respectively toward the moving strip 11. The etchant is sprayed with a pressure in the range of about 10 to 40 pounds per square inch. The sprayed etchant etches the exposed metal of the strip 11 and then drains to the sump. The etching chamber 23 has an entrance port 37 and an exit port 39. The sump 25 has an overflow port and pipe 45 which limits the level 47 of the etchant in the sump and also the amount of etchant in the apparatus. Excess amounts of etchant containing accumulated ferric and ferrous ions are removed from the apparatus through the overflow pipe 45. In one embodiment, the etchant in the sump 25 is maintained at 72°±2° C., and a specific gravity of about 1,469 (46.3° Baumé). In another embodiment, the etchant in the sump 25 is maintained at about 62°±2° C. and a specific gravity of 45.6 Baumé. In both embodiments, the concentration of ferric ions (which are produced by the etching of the strip 11) is controlled by oxidizing ferrous ions to ferric ions using chlorine gas and the continuous addition of deionized water and the overflow of used etchant.

GENERAL CONSIDERATIONS

In our published paper entitled "Ferric Chloride Etching of Low Carbon Steels", *RCA Review* 45, 73 to 89 (March 1984), we reported that abrupt transitions in surface roughness of the etch surfaces are observed as the Baumé is increased and/or the temperature of the etchant is decreased through narrow ranges, when etching low-carbon steels with ferric chloride etchant. When etching carbon steel sheet material to produce shadow masks in the factory, the ferric chloride etchant ordinarily has a Baumé and temperature which allows the shortest practical etching time but frequently produces a rough etch. For low resolution masks this is acceptable. However, medium and high resolution masks produced with these prior etchants exhibit unacceptable visual nonuniformity. Visual nonuniformity results from variations in the shape and size of the apertures and also in the shape and size of the spaces between apertures.

We have discovered that, concurrent with an abrupt increase in surface roughness when etching shadow masks, there is an increasing appearance of visual nonuniformity in the etched masks. Both of these characteristics appear to be manifestations of a change in the reaction kinetics occurring at the surface of the carbon steel during the etching step. We have further discovered that visual nonuniformity can be greatly reduced by using a ferric chloride etchant which produces a smooth etch. This requires a critical change in Baumé and/or temperature of the etchant from what is ordinarily used in the factory. Such change usually requires a longer etching time by running the strip slower through the etching chamber and/or providing a longer etching chamber.

Figure 2:
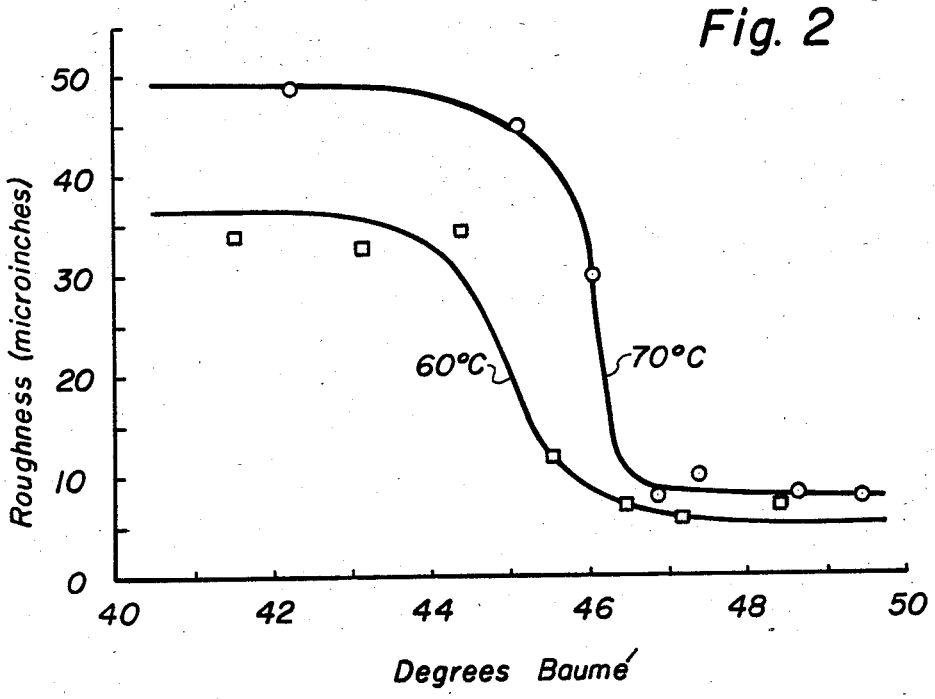
FIG. 2 are curves showing the roughness of the etched surface produced by ferric chloride etchants of different specific gravities expressed in Baumés at 60° and 70° C.

An example of the sudden transition in surface roughness that occurs, when etching low carbon steels in ferric chloride etchant as the Baumé of the etchant is varied at a constant temperature, is shown by the 70° C. curve in FIG. 2. Clearly, as the Baumé of the etchant decreases from a relatively high value, a region of smooth surface finish (<10 microinches) exists, which changes rapidly over a narrow Baumé region to a rough surface finish (>10 microinches) at lower Baumés. In addition, the region of changeover from smooth etch to rough etch is dependent upon temperature. This can be easily seen by comparing the 70° C. curve with the 60° C. curve shown in FIG. 2. Reducing the temperature of the etchant from 70° C. to 60° C., shifts the Baumé region of smooth to rough surface finish from about 46.2° Baumé to about 45.5° Baumé.

Figure 3:
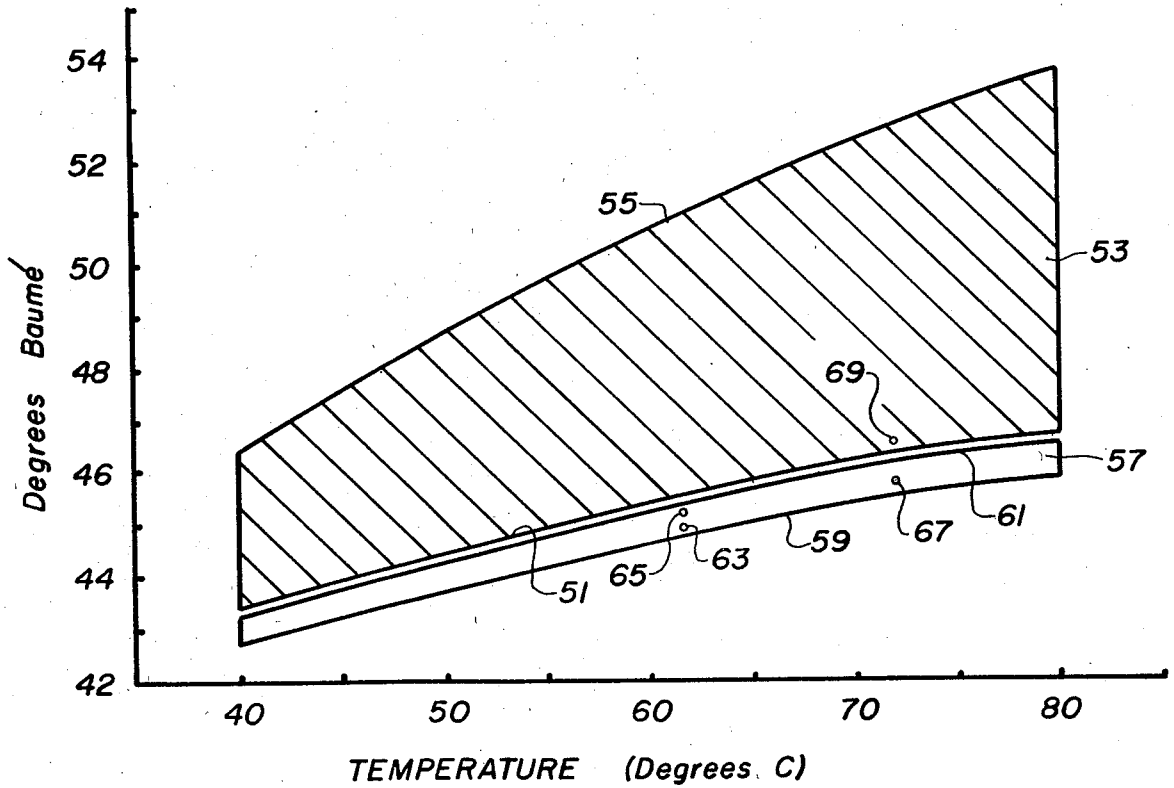
FIG. 3 is a diagram comparing conditions of temperature and specific gravity expressed in Baumé of ferric chloride etchant for the novel method and for a prior method.

We have extended this analysis to cover the temperature range considered in the art to be most practical for etching low-carbon steel shadow masks. This is shown in FIG. 3 covering the 40° C. to 80° C. temperature range. A new lower limit line 51 shown in FIG. 3 shows the minimum Baumé at each temperature within the 40°-to-80° C. temperature range for producing a maximum of 10 microinches of surface roughness. In order to produce an array of small-ratio apertures with sufficient smoothness to maintain good visual nonuniformity in shadow masks, it is absolutely necessary to maintain the Baumé and temperature above this lower limit line 51. The new lower limit line 51 in FIG. 3, defining the minimum Baumé necessary to maintain low visual nonuniformity as a function of temperature for etching small-ratio apertures, may be described by the empirical relationship $$y=25.05+4.97 \ln T$$

where T=temperature in degrees Celsius and y is the minimum Baumé required for realizing a smooth surface finish and good visual uniformity.

As is known in the art, etchants with higher Baumé tend to have slower etching rates, and hence, lower productivity. In order to maintain the highest rate of productivity at a particular temperature and still produce shadow masks with aperture size to thickness ratios less than about 0.90 with low visual nonuniformity, Baumé and temperature combinations as close to, but still above the lower limit line 51 in FIG. 3, should be used. However, the ranges in which the novel method will produce shadow masks with small-ratio apertures at an acceptable productivity is shown in the shaded new region 53 in FIG. 3 where the upper limit line 55 is described by the relation $$y=7.11+10.65 \ln T$$

and y and T are as previously defined.

There is an abrupt reduction of visual nonuniformity of nearest neighbor aperture size when using etchant with Baumé and temperature combination above the lower limit line 51. These conditions produce etch rates dominated by surface-limited reaction kinetics. Etching under these conditions produces very uniform etching rates and very uniform hole size distributions between nearest neighbor small-ratio apertures (size/thickness ratio less than about 0.9). Using an etchant with a Baumé and temperature combination below the new lower limit line 51 in FIG. 3 produces an etch rate dominated by transport-limited kinetics. These conditions produce nonuniform etch rates due to preferential attack by the ferric chloride etchant upon the grain boundaries in the low carbon steel. This results in nonuniform hole sizes among nearest neighbor apertures and also contributes to the surface roughness observed inside the apertures.

FIG. 3 also shows the prior region 57 of temperature Baumé combinations previously used for etching large-ratio apertures (aperture size/thickness ratio greater than 1.0) into low-carbon steel sheet with ferric chloride etchant. This prior region 57 is limited in temperature to the 40°-to-80° C. range and by an old lower limit line 59 and an old upper limit line 61. Most prior etching was carried out with combinations at or near the old lower limit line 59. In some cases, as indicated by the points 63, 65 and 67, the Baumé of the etchant approached, but did not reach the new lower limit line 51. The new lower limit line 51 and the old upper limit line 61 are separated by about 0.2° Baumé for all temperatures. The old upper limit line 61 is described by the relation $$y=24.85+4.97 \ln T.$$

Etchants in the prior area 57 are good for rapidly etching large-ratio apertures, but are not good for etching small-ratio apertures because of poor process control and unacceptably high visual nonuniformity. Etchants in the new area 53 are not good for etching large-ratio apertures because etching occurs too slowly, but are good for etching small-ratio apertures with good process control and low visual nonuniformity. Etchants in the area between the new area 53 and the prior area 57 etch too slowly for etching large-ratio apertures and are poor for etching small-ratio apertures because of poor process control and unacceptable visual nonuniformity. Considering etchants on the new lower limit line 51 to etch at a 100% rate, etchants on the new upper limit line 55 etch at about a 50% rate and etchants on the old lower limit line 59 etch at about a 120% rate for the same temperature.

In a comparative study, the major surfaces of a strip of 1001 AK (aluminum-killed) steel about 5.5 mils thick was provided with registered acid-resistant stencils for 13V size high resolution shadow masks, having aperture size/thickness ratio of about 0.88 for the majority of the apertures. The strip length was divided into two parts. One part was etched in the apparatus of FIG. 1 with 72° C. and 45.7° Baumé ferric chloride etchant (point 67, FIG. 3), produced masks with high visual nonuniformity, surface roughness in excess of 10 microinches on the inside surfaces of the small-ratio apertures, and nonuniform hole size among nearest neighbors. The other part of the strip was etched in the apparatus of FIG. 1, with 72° C. and 46.3° Baumé ferric chloride etchant, (point 69, FIG. 3), produced masks with low visual nonuniformity, a surface roughness of less than 10 microinches on the inside surfaces of the apertures, and uniform hole sizes among nearest neighbor small-ratio apertures. In addition, a relatively sharp edge was produced at each aperture periphery. Thus, a relatively small change in Baumé resulted in a significant change in the characteristics of the small-ratio apertures.

The novel method may be applied to etching various carbon steels, especially low-carbon steels, with ferric chloride etchant. By low-carbon steel is meant steels with a carbon content of 0.1 weight percent or less. This may be a rimmed steel, an aluminum-killed steel or an interstitial-free steel. The steel may be hot-rolled or cold-rolled and may be decarburized.

What is claimed is:

1. A method for etching an array of apertures through a carbon-steel sheet wherein, for each of the majority of said apertures, the ratio of the desired smallest cross-sectional dimension thereof to the thickness of said sheet is less than about 0.9, said sheet having etch-resistant stencils on opposite major surfaces thereof, said method comprising contacting said stencilled major surfaces with ferric chloride etchant having a specific gravity in a range at which a smooth finish is realized.

2. The method defined in claim 1 wherein said etchant has a temperature in the range of about 40° to 80° C. and a minimum specific gravity $y_{min}$ in degrees Baumé defined by the relation $$y_{min}=25.05+4.97 \ln T$$

wherein: T is the etchant temperature in degrees Celsius.

3. The method defined in claim 2 wherein said etchant has a maximum specific gravity $y_{max}$ in degrees Baumé defined by the relation $$y_{max}=7.11+10.65\ ln\ T.$$

4. The method defined in claim 2 wherein said etchant has a specific gravity in the range of about 44° to 54° Baumé.

5. The method defined in claim 2 wherein said etchant has a specific gravity within 1° Baumé above $y_{min}$.

6. The method defined in claim 2 wherein said sheet is of low-carbon steel containing less than 0.10 weight percent carbon and selected from the group consisting of rimmed steel, aluminum-killed steel and interstitial-free steel.

7. A method for etching an array of closely-positioned apertures through a carbon-steel sheet wherein, for each of the majority of said apertures, the ratio of the desired smallest cross-sectional dimension thereof to the thickness of said sheet is less than about 0.9, said sheet having etch-resistant stencils on opposite major surfaces thereof, said method comprising contacting said stencilled major surfaces with ferric chloride etchant until said apertures are produced, said etchant having a temperature T in the range of about 60° to 80° C. and a specific gravity within 1° Baumé above $y_{min}$ wherein $$y_{min}=25.05+4.97\ ln\ T.$$

8. The method defined in claim 7 wherein T is about 60° to 64° C. and $y_{min}$ is about 45.6° Baumé.

9. The method defined in claim 7 wherein T is about 70° to 74° C. and $y_{min}$ is about 46.3° Baumé.

* * * * *